United States Patent [19]

Tajima

[11] Patent Number: 4,688,958

[45] Date of Patent: Aug. 25, 1987

[54] PAPER FEEDING MECHANISM FOR PRINTER

[75] Inventor: Akio Tajima, Tokyo, Japan

[73] Assignee: Seikosha Co., Ltd., Tokyo, Japan

[21] Appl. No.: 923,403

[22] Filed: Oct. 27, 1986

[30] Foreign Application Priority Data

Oct. 30, 1985 [JP] Japan ..... 60-243323

[51] Int. Cl.[4] ..... B41J 13/036

[52] U.S. Cl. ..... 400/636.3; 400/637.1

[58] Field of Search ..... 400/636.3, 637, 637.1, 400/636, 636.1, 636.2, 637.3, 637.4, 638, 639.2

[56] References Cited

U.S. PATENT DOCUMENTS 1,988,189 1/1935 Dobson ..... 400/637.1

4,641,830 2/1987 Okuda et al. ..... 400/637.1

*Primary Examiner*—Edgar S. Burr

*Assistant Examiner*—James Lisehora

*Attorney, Agent, or Firm*—Bruce L. Adams; Van C. Wilks

[57] ABSTRACT

Disclosed is a paper feeding mechanism for a printer which comprises: a pinch roller urged against a platen; a platen bearing for rotatably supporting the platen; a cam portion formed on the platen bearing; a paper pressing lever for supporting a paper pressing roller; a connecting lever for driving the paper pressing lever in response to rotation of the cam portion; a cam follower lever fixed on a rotatable support shaft and provided with a cam follower engageable with a cam surface of the cam portion; a support arm fixed on the support shaft so as to be displaced in response to rotation of the support shaft; a roller receiver for bearing the pinch roller at one end portion of the roller receiver; connecting means for rotatably movably connecting a tip end portion of the support arm and the other end of the roller receiver; a tension spring stretched between the support arm and the roller receiver; and a protrusion and a protrusion receiver provided on one and the other of the support arm and the roller receiver respectively, the protrusion and the protrusion receiver being disposed at a position slightly separated from a line of action of spring force of the tension spring toward the connecting means. The cam surface of the cam portion includes a first, a second and a third positioning cam surface portion different in radius from each other, the first, second and third positioning cam surface portions being selectively followed by the cam follower for displacing the cam follower lever into selected one of three swung positions. The cam surface further includes a switch pressing cam surface portion for turning on/off a switch of a paper feeding motor.

1 Claim, 7 Drawing Figures

PAPER FEEDING MECHANISM FOR PRINTER

BACKGROUND OF THE INVENTION

1. Field of the Invention

The present invention relates to a paper feeding mechanism for a printer.

2. Description of the Prior Art

Conventionally, large-sized printers provided with automatically loading mechanism have been used as output devices of word processors or the like. In such an automatically loading mechanism, a paper pressing roller is separated from platen by an operation lever projected outward, and then a push-button is depressed to start a paper feeding motor so that a paper is automatically drawn in. As another example of the paper feeding mechanisms, there have been frictionally paper feeding mechanisms having such a structure that a spring is fixed to a frame of a printer and a pinch roller is held by the spring, or such a structure that a pinch roller is pressed by a spring attached on a bottom plate of a printer.

In such automatically loading mechanisms and frictionally paper feeding mechanisms in the prior art, operations are complicated because both the operations of the operation lever and the push-button are required. Further, when recording paper is inserted as well as fed, the resilient force by which the pinch roller is urged against the platen is always so strong that the recording paper does not facilitate to be inserted between the platen and the pinch roller even if the front end of the recording paper has come into contact with the pinch roller. Thus, it is not easy to set the recording paper. Further, when the recording paper is fed by a pin tractor or the like, it is necessary to separately provide a mechanism for causing a pinch roller to separate from a platen against a spring, resulting in a complicated structure.

SUMMARY OF THE INVENTION

It is an object of the present invention to provide a paper feeding mechanism for a printer in which a recording paper can be automatically drawn in by a simple operation.

It is another object of the present invention to provide a paper feeding mechanism for a printer in which a recording paper can be surely inserted between a platen and a pinch roller.

It is a further object of the present invention to provide a paper feeding mechanism for a printer in which insertion of a recording paper can be easily corrected in the case which the recording paper is drawn in a wrong manner, for example, slantingly.

It is a still further object of the present invention to provide a paper feeding mechanism for a printer in which an appropriate tensile force can be applied to a recording paper even in the case of tractor feeding.

The present invention is featured in that a knob is connected with an outward projecting end of a platen bearing provided with a cam portion, and in that a paper pressing lever is made swing through a connecting bar arranged to follow rotation of the cam portion to thereby cause a paper pressing roller to come into contact with or to come off from a platen. Further, a switch of a paper feeding motor is turned on/off by a switch pressing cam surface portion formed on the cam portion. A cam follower lever has a cam follower for selectively following a first, a second, and a third positioning cam surface portion which are formed on the cam portion and which are different in radius from each other so that the cam follower lever is made displaceable into selected one of three swung positions. The cam follower lever is fixed to a support shaft which is rotatably supported. A support arm is fixed to the support shaft and swung to displace corresponding to the three swung positions of the cam follower lever. A roller receiver is connected with the support arm at one end portion thereof, and a pinch roller for applying friction onto recording paper is borne at the other end portion of the roller receiver. A tension spring is stretched between the support arm and the roller receiver, and a protrusion and a protrusion receiver are provided on one and the other of the support arm. The protrusion and the protrusion receiver are respectively positioned at a position a little separated from a line of action of the spring force of the tension spring toward a connecting portion between the support arm and the roller receiver. Thus, the force for urging the pinch roller against the platen can be changed corresponding to the three swung positions of the cam follower lever and the support arm which can be selected by turning the knob.

Accordingly, in inserting recording paper, only by an operation of turning the knob, the cam portion is rotated to make the paper pressing roller separate from the platen, and at the same time cam surface followed by the cam follower shifts from the first positioning cam surface portion to the second positioning cam surface portion to thereby turn on the switch of the paper feeding motor. If the knob is turned further, the cam surface followed by the cam follower shifts from the second positioning cam surface portion to the third positioning cam surface portion, so that the support arm is swung, the fulcrum of the roller receiver by means of the support arm is changed, the rotation moment is changed at the fulcrum, and the force for urging the pinch roller against the platen is changed. That is, when the cam follower follows the first positioning cam surface portion, the paper pressing roller is resiliently urged against the platen, at the same time the switch is turned off, and the pinch roller is also elastically urged against the platen with strong urging force. When the cam follower follows the second positioning cam surface portion, the switch is turned on and the pinch roller is resiliently urged against the platen with a less strong urging force. When the cam follower follows the third positioning cam surface portion, the switch is kept on and the pinch roller is resiliently urged against the platen with weak urging force.

Other features and advantages of the invention will be apparent from the following description taken in connection with the accompanying drawings.

DETAILED DESCRIPTION OF PREFERRED EMBODIMENT

Figure 1:
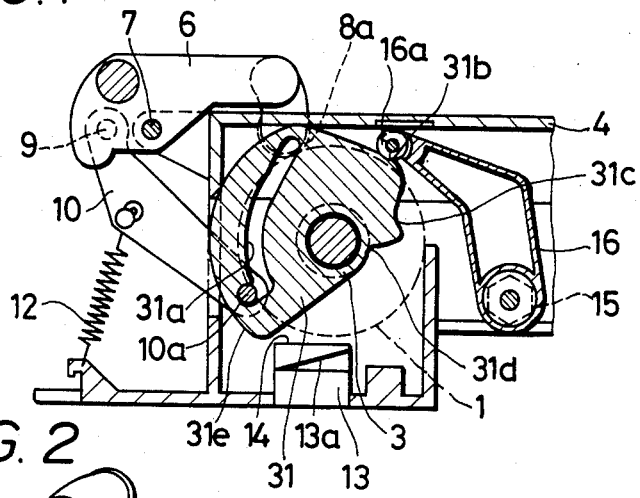
FIG. 1 to 3 are cross-sections taken along a line I—I in FIG. 7 for explaining the operations of an embodiment of the present invention.

Referring to the drawings, an embodiment according to the present invention will be described hereunder.

Figure 4:
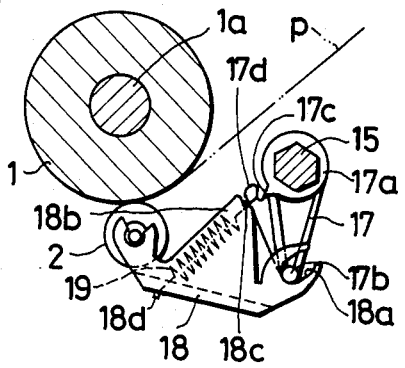
FIG. 4 to 6 are cross-sections taken along a line IV—IV in FIG. 7 for explaining the operations of the embodiment.
Figure 7:
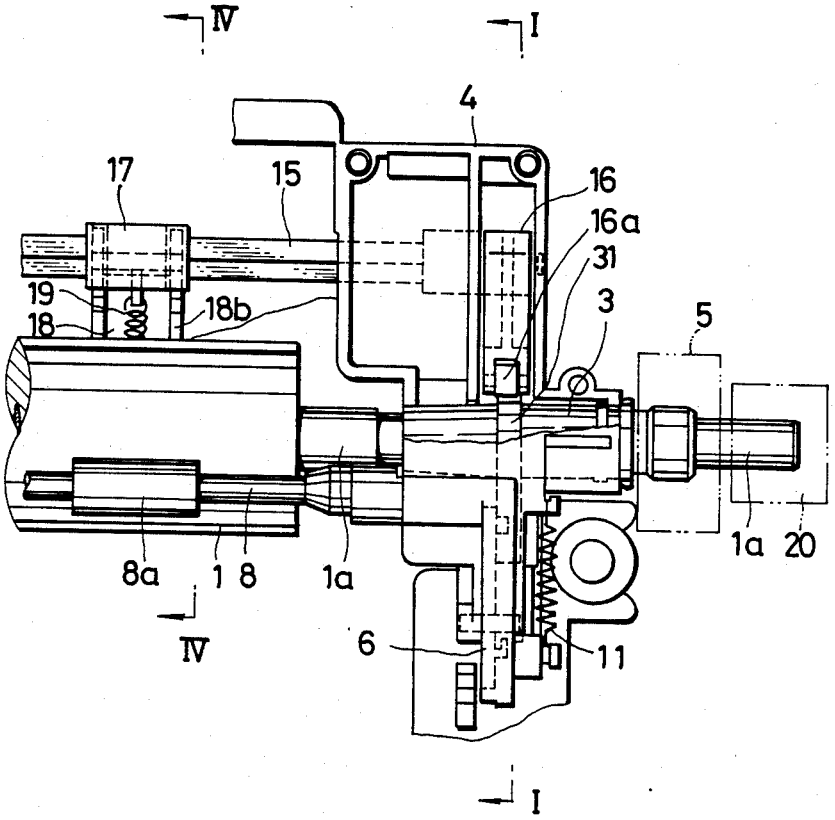
FIG. 7 is a partially broken plan view of the embodiment.

In FIGS. 1, 4 and 7, a platen 1 is arranged to be driven to rotate in paper feeding, and a pinch roller 2 (FIG. 4) is resiliently urged against the platen 1. In setting, a recording paper P is fed between the platen 1 and a pinch roller 2. A shaft 1*a* of the platen 1 is rotatably passed through a platen bearing 3 (FIGS. 1 and 7) which is rotatably supported by a frame 4 of a printer. The platen bearing 3 is provided at its outward projecting end with a knob 5 fixed thereto (FIG. 7) and at its intermediate portion with a cam portion 31. A slot 31*a* is formed in a side surface of the cam portion 31, and the cam portion 31 has a cam surface including a first positioning cam surface portion 31b, a second positioning cam surface portion 31*c*, and a third positioning cam surface portion 31*d* which are different in radius from each other. The cam surface further includes a switch pressing cam surface portion 31*e*. A paper pressing lever 6 is rotatably attached to a shaft 7 provided on the frame 4. A paper pressing roller 8*a* for applying friction to the recording paper P in feeding out the paper P in a friction feeding mode is rotatably mounted on a shaft 8 which is supported by the paper pressing lever 6 at one end portion thereof. A connecting bar 10 is rotatably attached at its one end to the other end of the paper pressing lever 6 through a connecting pin 9. A pin 10*a* is projectingly formed on the connecting bar 10 at the other end of the latter and inserted into the slot 31*a* to follow the rotation of the cam portion 31. A tension spring 11 is stretched between the paper pressing lever 6 and the frame 4 (FIG. 7), and another tension spring 12 is stretched between the connecting bar 10 and the frame 4 (FIG. 1). A switch 13 for a paper feeding motor (not shown) is disposed under the cam portion 31 and arranged to be turned on when an actuator member 13*a* of the switch 13 is depressed by the switch pressing cam surface portion 31*e*. A stage portion 14 is arranged to lift an end portion of the connecting bar 10 in the side of the pin 10*a*. A support shaft 15 is disposed in parallel with the platen 1 and rotatably suported by the frame 4. A lever 16 is fixed at its one end portion to the end portion of the support shaft 15, so that the lever 16 is arranged to be pivotal at its one end. A cam follower 16*a* is rotatably provided on the other end of the lever 16 so as to be able to follow the rotation of the cam portion 31 to thereby cause the lever 16 and the support shaft 15 to swing and rotate respectively.

A support arm 17 is fixed on the support shaft 15 (FIG. 7). The support arm 17 is integrally extended from a boss portion 17*a* fittingly mounted on the support shaft 15, and is integrally provided at its tip end portion with a connecting shaft 17*b*. A protrusion 17*c* is formed at a portion of the boss portion 17*a* (FIG. 4). A spring hanger 17*d* is integrally formed on the support arm 17 at a position nearer to the platen 1 by a slight distance than the protrusion 17*c*. A roller receiver 18 is connected with the support arm 17. That is, the pinch roller 2 is rotatably supported at one end portion of the roller receiver 18, so as to be resiliently in contact with the platen 1. A connecting notch 18*a* is formed in the other end portion of the roller receiver 18 so that the connecting shaft 17*b* is rotatably and movably engaged with the connecting notch 18*a*. An upright bent portion 18*b* is respectively formed at each of the opposite sides of the roller receiver 18, and a protrusion receiver 18*c* is concavely formed in the upright bent portion 18*b* so as to be engageable with the protrusion 17*c*. A spring hanger 18*d* is formed on the roller receiver 18 and a tension spring 19 is stretched between the spring hanger 18*d* and the spring hanger 17*d* of the support arm 17.

Figure 6:
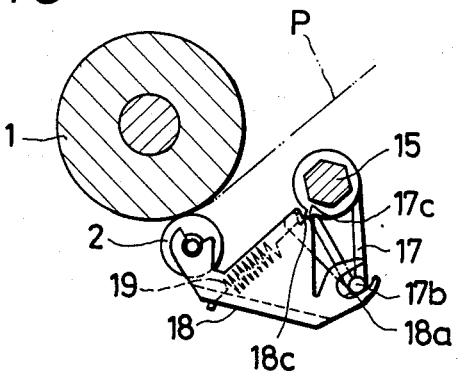

As shown in FIG. 6, the support arm 17 swings only within an angular range from a retreated position where the support arm 17 is swung and displaced in the direction opposite to the roller receiver 18 to an advanced position (see FIG. 4) where the support arm 17 is swung and displaced toward the roller receiver 18 in response to the rotation of the support shaft 15 owing to swing of the lever 16. A knob 20 for turning the shaft 1*a* of the platen 1 is fixed on a tip end of the shaft 1*a* as seen in FIG. 7.

Figure 2:
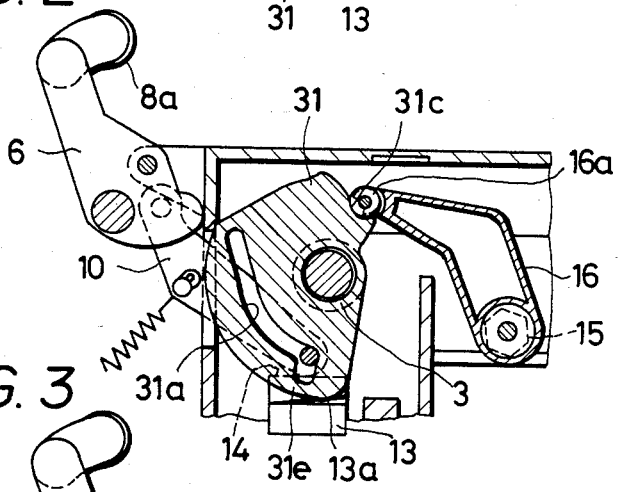

In feeding paper, when the knob 5 is turned counterclockwise after the recording paper P is fed between the platen 1 and the pinch roller 2, the platen bearing 3 rotates counterclockwise, and the cam portion 31 rotates counterclockwise to cause the pin 10*a* inserted in the engaging portion of the slot 31*a* as shown in FIG. 1 to follow the cam portion 31 to reach such a position as shown in FIG. 2. As the cam portion 31 rotates, the connecting bar 10 is moved by the pin 10*a*, the paper pressing lever 6 is swung counterclockwise to raise the paper pressing roller shaft 8, and the paper pressing roller 8*a* is separated from the platen 1. In the position of FIG. 2, an end portion of the connecting bar 10 where the pin 10*a* is formed is lifted by the stage portion 14 so as to cause the pin 10*a* to come off from the engaging portion of the slot 31*a* to a sliding portion, so that the pin 10*a* becomes impossible to follow the rotation of the cam portion 31 thereafter. Further, in the position of FIG. 2, the switch pressing cam surface portion 31*e* of the cam portion 31 presses down the operation member 13*a* of the switch 13 to close the switch 13, so that the paper feeding motor is started and the recording paper P is drawn in. Upon the lapse of a predetermined period of time after the front end of the recording paper P has passed in front of a reflection-type sensor (not shown), the paper feeding motor is stopped with the recording paper P set at a predetermined position.

As shown in FIG. 1, when the cam follower 16*a* is resiliently in contact with the first positioning cam surface portion 31*b* of the cam portion 31, the support shaft 15 is in the position shown in FIG. 4. At that time, the support arm 17 is in its advanced position and the roller receiver 18 is pushed forward to its advanced position by the support arm 17 through the connecting portion thereof, so that the protrusion 17*c* and the protrusion receiver 18*c* are separated from each other to extend the tension spring 19. Accordingly, means for connecting the connecting shaft 17*b* and the connecting notch 18*a* forms a fulcrum for the movement of the pinch roller 2 and the fulcrum is separated far away from a line of action of spring force, that is, a line connecting the spring hangers 17*d* and 18*d*, so that the pinch roller 2 is resiliently urged against the platen 1 with strong urging force.

Figure 5:
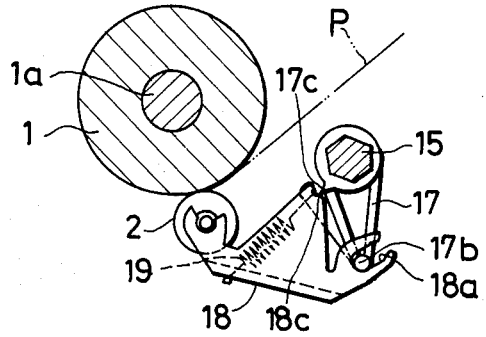

As shown in FIG. 2, when the cam follower 16*a* is resiliently urged against the second positioning cam surface portion 31*c*, the support shaft 15 rotates a little counterclockwise from the position as shown in FIG. 4 as shown in FIG. 5. At that time, the connecting means consisting of the connecting shaft 17*b* and the connecting notch 18*a* is retreated a little from the position as shown in FIG. 4 and the pinch roller 2 is also retreated a little, but the protrusion 17*c* and the protrusion receiver 18*c* are separated a little from each other, so that the spring force of the tension spring 19 is exerted onto the platen 1 through the pinch roller 2 with the above-mentioned connecting means as a fulcrum to thereby resiliently urge the pinch roller 2 against the platen 1 with sufficiently large urging force while the urging force is slightly weaker than that in the position as shown in FIG. 4.

Figure 3:
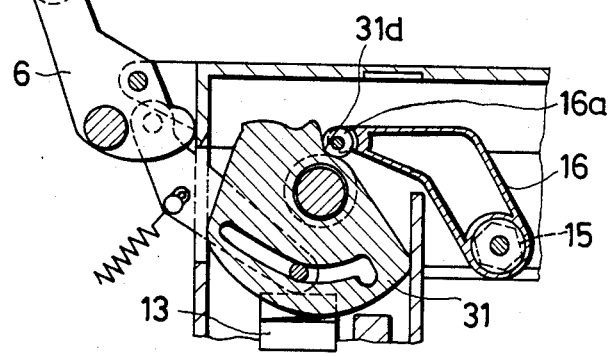

As described above, recording paper P is inserted between the platen 1 and the pinch roller 2 in the position as shown in FIGS. 2 and 5. In the case where the recording paper is drawn in a wrong manner, for example, slantingly, however, the knob 5 is further turned counterclockwise so as to correct the posture of the recording paper. When the cam portion 31 comes to the position as shown in FIG. 3, the connecting bar 10 does not move together with the cam portion 31 because the pin 10*a* slides in the sliding portion of the slot 31*a*, so that the posture of the paper pressing lever 6 is not changed. Because the cam follower 16*a* is resiliently urged against the third positioning cam surface portion 31*d*, however, the support shaft 15 rotates further counterclockwise the the position as shown in FIG. 6. At that time, the support arm 17 is in the retreated position and the protrusion receiver 18*c* is engaged with the protrusion 17*c* by the spring force of the tension spring 19 and the roller receiver 18 is maintained with the engaging position as a fulcrum. Because the fulcrum at that time is extremely near to a line of action of the spring force of the tension spring 19, the pinch roller 2 is resiliently urged against the platen 1 with weak urging force. In that position, the pinch roller 2 is more retreated than the position shown in FIG. 5. Accordingly, if the knob 5 is turned, the state as shown in FIG. 5 is changed into the state as shown in FIG. 6, and then a slant or the like of the recording paper P is corrected so that the recording paper having a correct posture can be sandwiched between the platen 1 and the pinch roller 2. Even in the state shown in FIGS. 3 and 6, the switch 13 is closed, and therefore if the state is turned back to the state as shown in FIGS. 2 and 5 to make the urging force acting on the pinch roller stronger, the recording paper P in the correct posture can be fed to a predetermined position by the operation of the paper feeding motor.

When printing is performed after the recording paper P has been set, the state is returned back to the state as shown in FIGS. 1 and 4, where the paper pressing lever 6 is returned into its original position, the paper pressing roller 8*a* is resiliently urged against the platen 1 with the recording paper P sandwiched therebetween, and the pinch roller 2 is also resiliently urged against the platen 1 by large urging force with the recording paper P sandwiched therebetween, so that the recording paper P is frictionally fed while being printed owing to the operation of the paper feeding motor.

When the recording paper P is printed in tractor feeding, if the state is brought into that shown in FIGS. 3 and 6, the pinch roller 2 is resiliently urged against the platen 1 with weak urging force with the recording paper P sandwiched therebetween, so that appropriate tensile force is applied onto the recording paper to thereby make it possible to perform clear printing.

According to the present invention, only by turning the knob connected with the platen bearing, the paper pressing roller is separated from the platen and at the same time the switch of the motor for feeding the recording paper is turned on, so that the recording paper can be automatically drawn in with a simplified structure as well as an improved operation property. When recording paper is drawn in a slanted or displaced manner, only by an operation of further turning the knob, the urging force acting on the pinch roller can be made weak and the recording paper can be surely inserted in its corrected posture between the platen and the pinch roller, thereby making it sure to automatically draw in the recording paper. Further, when recording paper is tractor-fed, appropriate weak urging force is applied to the pinch roller for urging the pinch roller against the platen, so that appropriate tensile force can be kept being exerted onto the recording paper to make printing clear.

What is claimed is:

1. A paper feeding mechanism for a printer comprising:

a platen driven to rotate in feeding of a paper: a pinch roller urged so as to resiliently contact with said platen;

a platen bearing for rotatably supporting said platen, said platen bearing being arranged to be rotatable by turning a knob fixed to an outward projecting end of said platen bearing and having a cam portion;

a rotatable paper pressing lever for supporting a paper pressing roller;

a connecting lever for swingingly driving said paper pressing lever in response to rotation of said cam portion;

a cam follower lever fixed on a rotatable support shaft and provided at its end portion with a cam follower engageable with a cam surface of said cam portion;

a support arm fixed on said support shaft so as to be swingingly displaced in response to rotation of said support shaft;

a roller receiver for bearing said pinch roller at one end portion thereof;

connecting means for rotatably and movably connecting one end portion of said support arm and the other end portion of said roller receiver;

a tension spring stretched between said support arm and said roller receiver;

a protrusion and a protrusion receiver provided on one and the other of said support arm and said roller receiver respectively, said protrusion and said protrusion receiver being disposed at a position slightly separated from a line of action of a spring force of said tension spring toward said connecting means;

said cam surface of said cam portion including first, second and third positioning cam surface portions which are different in radius from each other, said first, second and third positioning cam surface portions being selectively followed by said cam follower for displacing said cam follower lever into selected one of three rotational positions, said cam surface further including a switch pressing cam surface portion for turning on/off a switch of a paper feeding motor.

* * * * *